US008235382B2

(12) United States Patent
Taniguchi et al.

(10) Patent No.: US 8,235,382 B2
(45) Date of Patent: Aug. 7, 2012

(54) PAPER SHEET STACKING APPARATUS

(75) Inventors: Tetsuya Taniguchi, Himeji (JP); Kaname Kotani, Hyogo-Ken (JP)

(73) Assignee: Glory Ltd., Hyogo-Ken (JP)

( * ) Notice: Subject to any disclaimer, the term of this patent is extended or adjusted under 35 U.S.C. 154(b) by 0 days.

(21) Appl. No.: 13/203,259

(22) PCT Filed: Feb. 26, 2010

(86) PCT No.: PCT/JP2010/053103

§ 371 (c)(1),
(2), (4) Date: Aug. 25, 2011

(87) PCT Pub. No.: WO2010/098450

PCT Pub. Date: Sep. 2, 2010

(65) Prior Publication Data

US 2011/0309566 A1 Dec. 22, 2011

(30) Foreign Application Priority Data

Feb. 26, 2009 (JP) ..... 2009-44237

(51) Int. Cl.
*B65H 29/20* (2006.01)

(52) U.S. Cl. ..... 271/187; 271/315

(58) Field of Classification Search ..... 271/187, 271/314, 315

See application file for complete search history.

(56) References Cited

U.S. PATENT DOCUMENTS

| | | | | |
|---|---|---|---|---|
| 4,431,177 | A * | 2/1984 | Beery et al. | 271/186 |
| 5,065,997 | A * | 11/1991 | Butts et al. | 271/187 |
| 5,114,135 | A | 5/1992 | Evangelista et al. | |
| 5,692,740 | A * | 12/1997 | Holtje | 270/58.01 |
| 5,803,705 | A * | 9/1998 | Keyes | 414/793.9 |
| 6,019,209 | A * | 2/2000 | Hara et al. | 194/206 |
| 6,619,653 | B2 * | 9/2003 | Dobrindt | 271/83 |
| 2004/0251622 | A1 * | 12/2004 | Dobrindt | 271/315 |
| 2004/0256798 | A1 * | 12/2004 | Dobrindt | 271/315 |

FOREIGN PATENT DOCUMENTS

JP 62-34558 2/1987

* cited by examiner

*Primary Examiner* — David H Bollinger

(74) *Attorney, Agent, or Firm* — Renner, Kenner, Greive, Bobak, Taylor & Weber

(57) ABSTRACT

A paper sheet stacking apparatus includes: a feeding unit 26 configured to feed in paper sheets one by one from outside; a rotary body 10 including a holding member 16 for holding the paper sheet fed in by the feeding unit 26, the rotary body 10 being configured to be rotated with the paper sheet being held by the holding member 16, so as to transport the paper sheet along a rotational direction of the rotary body 10; and a stacking unit 32 on which the paper sheets transported by the rotary body 10 are stacked on one another.

13 Claims, 8 Drawing Sheets

PAPER SHEET STACKING APPARATUS

FIELD OF THE INVENTION

The present invention relates to a paper sheet stacking apparatus configured to stack paper sheets sent from outside on one another. In particular, the present invention relates to a paper sheet stacking apparatus capable of restraining a failure in stacking condition of paper sheets on a stacking unit.

BACKGROUND ART

As a paper sheet stacking apparatus for stacking paper sheets, such as banknotes, checks, coupons or other valuable media, on one another, an apparatus disclosed in JP2002-193517A is known. In the paper sheet stacking apparatus disclosed in JP2002-193517A, various kinds of paper sheets are collectively received in a paper sheet supply unit, the paper sheets are taken into a housing one by one from the paper sheet supply unit and transported along a transport path, and denominations and/or fitness of the paper sheets are judged by a judging unit. Based on the judgment result, the paper sheets that have been judged by the judging unit are divided into fit notes and reject notes and so on, and are stacked on a stacking unit.

In the paper sheet stacking apparatus disclosed in JP2002-193517A, the stacking unit is provided with a rotatable stacking wheel. A plurality of vanes are arranged at an interval equal to each other, on an outer circumferential surface of a cylindrical body part of the stacking wheel. During the rotation of the stacking wheel, a paper sheet is sent into between a pair of vanes, and the paper sheet sandwiched between the pair of vanes is transported up to the stacking unit along a rotational direction of the stacking wheel. Due to the provision of such a rotatable stacking wheel on the stacking unit, paper sheets sandwiched between the pairs of the vanes of the stacking wheel can be stacked on one another on the stacking unit.

FIG. 14 shows a structure of a conventional paper sheet stacking apparatus in which a stacking unit is provided with a stacking wheel. The paper sheet stacking apparatus shown in FIG. 14 includes a feeding unit 52 configured to feed paper sheets one by one from an outside of the paper sheet stacking apparatus into an inside thereof, a rotatable stacking wheel 54 to which the paper sheets fed by the feeding unit 52 are sent, and a stacking stage 56 on which the paper sheets sent from the rotatable stacking wheel 54 are stacked on one another. A plurality of vanes 54*b* are arranged at an interval equal to each other, on an outer circumferential surface of a cylindrical body part 54*a* of the stacking wheel 54. The stacking wheel 54 can be rotated in the clockwise direction in FIG. 14 (direction shown by the arrow in FIG. 14) about a shaft 54*c*. During the rotation of the stacking wheel 54, a paper sheet P (indicated by the broken line in FIG. 14) is sent into between a pair of vanes 54*b*, and the paper sheet P sandwiched between the pairs of vanes 54*b* is transported up to the stacking stage 56 along the rotational direction of the stacking wheel 54.

SUMMARY OF THE INVENTION

However, in the paper sheet stacking apparatus shown in JP2002-193517A, in which the stacking unit is provided with the stacking wheel, and paper sheets are sandwiched between the pairs of vanes of the stacking wheel before the paper sheets are stacked on the stacking unit, when banknotes, such as EURO banknotes which remarkably differ in size for each denomination, are stacked on the stacking unit, there is a possibility that, when a large size banknote is sandwiched between the pair of vanes of the stacking wheel, the banknote might slip out from between the pair of vanes in the course of rotation of the stacking wheel, resulting in a failure in stacking condition of paper sheets. In particular, when a banknote having a large longitudinal length is sent to the stacking wheel along the longitudinal direction of the banknote, such a banknote is more likely to slip out from between the pair of vanes in the course of rotation of the stacking wheel. In addition, when various kinds of checks are stacked on the stacking unit, since the checks more remarkably differ in size as compared with banknotes, there is a larger possibility that a large size check sandwiched between the pair of vanes of the stacking wheel might slip out from therebetween in the course of rotation of the stacking wheel.

In addition, in the paper sheet stacking apparatus in which the stacking unit is provided with the stacking wheel, and paper sheets are sandwiched between the pairs of vanes of the stacking wheel before the paper sheets are stacked on the stacking unit, it is necessary to ensure, near to the stacking wheel, a space corresponding to a rotational trajectory of a paper sheet sandwiched between the pair of vanes. Thus, when large size banknotes or checks are stacked on the staking unit, it is necessary to ensure a large space near to the stacking wheel, whereby the paper sheet stacking apparatus is disadvantageously enlarged as a whole. To be specific, in the paper sheet stacking apparatus shown in FIG. 14, it is necessary to ensure a space of an area R, which is surrounded by the two-dot chain line in FIG. 14, as a space corresponding to the rotational trajectory of the paper sheet P sandwiched between the pair of vanes 54*b* of the stacking wheel 54. Thus, the paper sheet stacking apparatus should be enlarged correspondingly to the space of the area R.

In addition, when a creased paper sheet is sent to the stacking wheel, there is a possibility that the creased paper sheet could not be moved into a space between the pair of vanes of the stacking wheel, or that even though the creased paper sheet can be moved into the space between the pair of vanes, the creased paper sheet might slip off from between pair of vanes in the course of rotation of the stacking wheel, resulting in a failure in stacking condition of paper sheets.

The present invention has been made in view of above circumstances. The object of the present invention is to provide a paper sheet stacking apparatus capable of reliably stacking paper sheets fed from outside on one another on a stacking unit, and thus is capable of restraining a failure in stacking condition of paper sheets on the stacking unit.

A paper sheet stacking apparatus of the present invention which is configured to stack paper sheets sent from outside on one another, the paper sheet stacking apparatus includes: a feeding unit configured to feed in paper sheets one by one from outside; a rotary body including a holding member for holding the paper sheet fed in by the feeding unit, the rotary body being configured to be rotated with the paper sheet being held by the holding member, so as to transport the paper sheet along a rotational direction of the rotary body; and a stacking unit on which the paper sheets transported by the rotary body are stacked on one another.

According to such a paper sheet stacking apparatus, when a paper sheet, which has been fed in by the feeding unit from outside, is sent to the stacking unit by the rotary body, the paper sheet can be held by the holding member of the rotary body. Thus, there is no possibility that the paper sheet might separate from the rotary body in the course of rotation of the rotary body. As a result, as compared with a paper sheet stacking apparatus in which a paper sheet is sandwiched between a pair of vanes of a stacking wheel before the paper sheet is stacked on a stacking unit, paper sheets fed from outside can be reliably stacked on one another on the stacking unit. Therefore, a failure in stacking condition of paper sheets on the stacking stage can be restrained. In addition, as compared with a paper sheet stacking apparatus including a stacking wheel having a pair of vanes for sandwiching therebetween a paper sheet, since it is sufficient that only a part of the paper sheet is held by the holding member, the size of the rotary body can be reduced, whereby the reduction in size of the paper sheet stacking apparatus can be achieved.

In the paper sheet stacking apparatus of the present invention, it is preferable that the feeding unit is configured to feed in the paper sheets from outside along a substantially horizontal direction.

In the paper sheet stacking apparatus of the present invention, it is preferable that a direction, along which the paper sheet is transported by the feeding unit immediately before the paper sheet is delivered from the feeding unit to the rotary body, substantially corresponds to a direction, along which the paper sheet is transported by the rotary body immediately after the paper sheet has been delivered from the feeding unit to the rotary body.

In the paper sheet stacking apparatus of the present invention, it is preferable that the holding member is movable between a hold position at which the holding member is close to an outer circumferential surface of the rotary body so that a paper sheet is held between the holding member and the outer circumferential surface of the rotary body, and a retreat position at which the holding member is retreated from the outer circumferential surface of the rotary body.

At this time, it is further preferable that the holding member is provided with a holding member moving mechanism configured to move the holding member between the hold position and the retreat position, and that the holding member moving mechanism is configured to automatically move the holding member between the hold position and the retreat position, in accordance with the rotation of the rotary body.

In addition, in this case, it is further preferable that the paper sheet stacking apparatus further includes a cam whose position is fixed, the holding member moving mechanism has a member provided to the holding member, the member being configured to be moved along a periphery of the cam by the rotation of the rotary body, and when the rotary body is rotated, the member is moved along the periphery of the cam so that the holding member is moved between the hold position and the retreat position.

In the paper sheet stacking apparatus of the present invention, it is preferable that the feeding unit is provided with a paper sheet detection unit configured to detect a paper sheet fed in by the feeding unit from outside, and that when the paper sheet fed in by the feeding unit from outside is detected by the paper sheet detection unit, or after a predetermined period of time has passed from the time when the paper sheet was detected by the paper sheet detection unit, the rotary body is started to be rotated.

At this time, it is further preferable that the holding member is movable between a hold position at which the holding member is close to an outer circumferential surface of the rotary body so that a paper sheet is held between the holding member and the outer circumferential surface of the rotary body, and a retreat position at which the holding member is retreated from the outer circumferential surface of the rotary body, and before the paper sheet is delivered from the feeding unit to the rotary body, the holding member is located on the retreat position, and after a predetermined period of time has passed from the time when the paper sheet fed in by the feeding unit from outside was detected, the holding member is moved from the retreat position to the hold position so that the paper sheet sent from the feeding unit to the rotary body is held.

In addition, at this time, it is further preferable that the rotary body is rotated, with the paper sheet being held by the holding member, up to a stacking position at which the paper sheet is stacked on the stacking unit.

In addition, at this time, it is further preferable that when the event that the paper sheet fed in by the feeding unit from outside has passed through the paper sheet detection unit is detected, or after a predetermined period of time has passed from the time when the passage of the paper sheet through the paper sheet detection unit was detected, the paper sheet is released from the holding member which holds the paper sheet so far, so that the paper sheet is delivered from the rotary body to the stacking unit so as to be stacked on the stacking unit.

In the paper sheet stacking apparatus of the present invention, it is preferable that the paper sheet stacking apparatus further includes a transport assisting unit disposed near to the rotary body, the transport assisting unit being configured to guide, when the paper sheet is transported by the rotary body, an edge portion of the paper sheet, which is not held by the holding member, up to the stacking unit. Owing to this structure, when the edge portion of the paper sheet, which is not held by the holding member is guided by the transport assisting unit, an area through which the edge portion of the paper sheet passes is smaller than an area corresponding to a rotational trajectory of the edge portion of the paper sheet when the rotary body is rotated with the paper sheet being merely held by the holding member. Namely, the passage area of the paper sheet is limited by the transport assisting unit. Thus, even when paper sheets such as large size banknotes or checks are stacked on the stacking unit, a space required for the paper sheets to pass therethrough up to the stacking unit can be relatively made small, whereby the size of the paper sheet stacking apparatus can be reduced.

In the present invention, the transport assisting unit may be formed of an endless belt or a roller.

In addition, in the aforementioned paper sheet stacking apparatus, it is preferable that a speed at which the paper sheet is transported by the transport assisting unit is equal to or greater than a speed at which the paper sheet is transported by the feeding unit. If the feeding speed of the paper sheet by the feeding unit is greater than the transport speed of the paper sheet by the transport assisting unit, since the transport speed of the paper sheet by the transport assisting unit is relatively small, a part of the paper sheet that has passed through the feeding unit may be curved. In this case, the paper sheet cannot be appropriately guided by the transport assisting unit up to the stacking unit, and there is a possibility that the paper sheet stacking apparatus might be jammed with paper sheets. On the other hand, when the transport speed of the paper sheet by the transport assisting unit is equal to or greater than the transport speed of the paper sheet by the feeding unit, such a trouble can be avoided.

In addition, in the aforementioned paper sheet stacking apparatus, it is further preferable that when seen along an axial direction of the rotary body, the transport assisting unit is disposed on a position that is overlapped with the holding member immediately before the paper sheet is delivered from the feeding unit to the rotary body. In addition, it is further preferable that immediately before the paper sheet is delivered from the feeding unit to the rotary body, an end of the holding member for holding the paper sheet is located on a position that is more distant from an outer circumferential surface of the rotary body than the transport assisting unit.

Owing to this structure, when the paper sheet, which has been fed in by the feeding unit, is delivered to the rotary body, the front edge portion of the paper sheet in the transport direction is reliably sent to a space between the outer circumferential surface of the rotary body and the transport assisting unit. Since this space is located between the outer circumferential surface of the rotary body and the holding member, the front edge portion of the paper sheet that is present in the space can be reliably held between the outer circumferential surface of the rotary body and the holding member, when the holding member is moved from the retreat position to the hold position. Thus, even if the front edge portion of the paper sheet fed in by the feeding unit is creased, the creased paper sheet can be reliably held by the holding member.

DETAILED DESCRIPTION OF THE INVENTION

Figure 1:
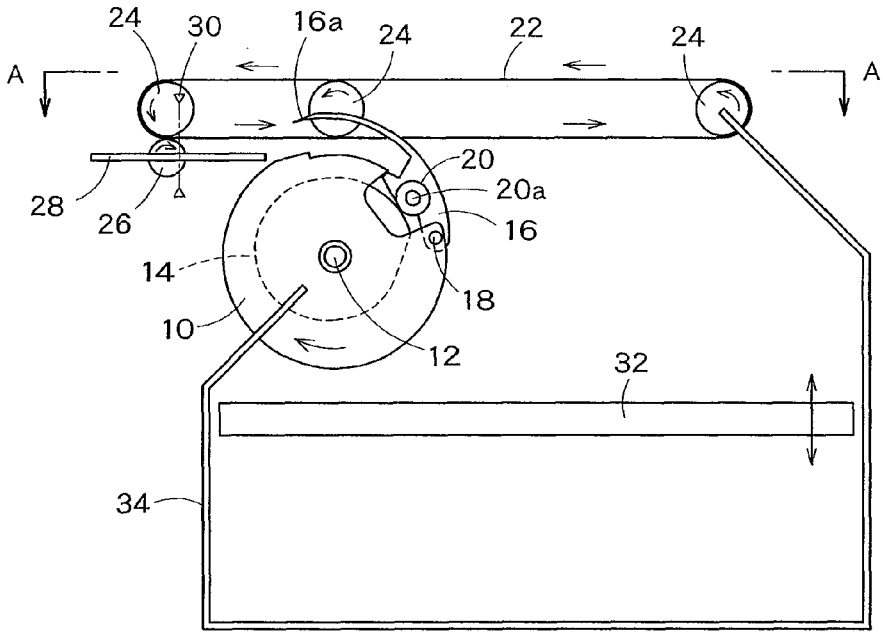
FIG. 1 is a side view showing a structure of a paper sheet stacking apparatus in one embodiment according to the present invention.
Figure 2:
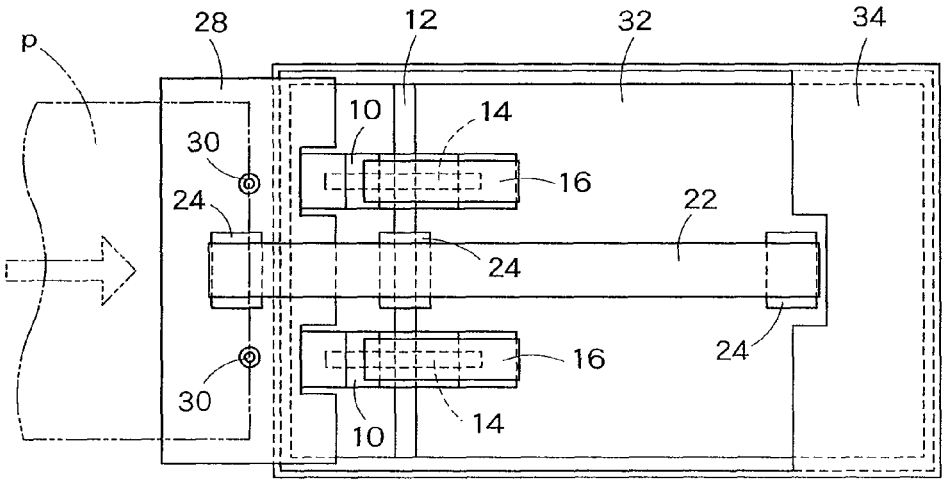
FIG. 2 is a top view taken along the line A-A of the paper sheet stacking apparatus shown in FIG. 1.
Figure 3:
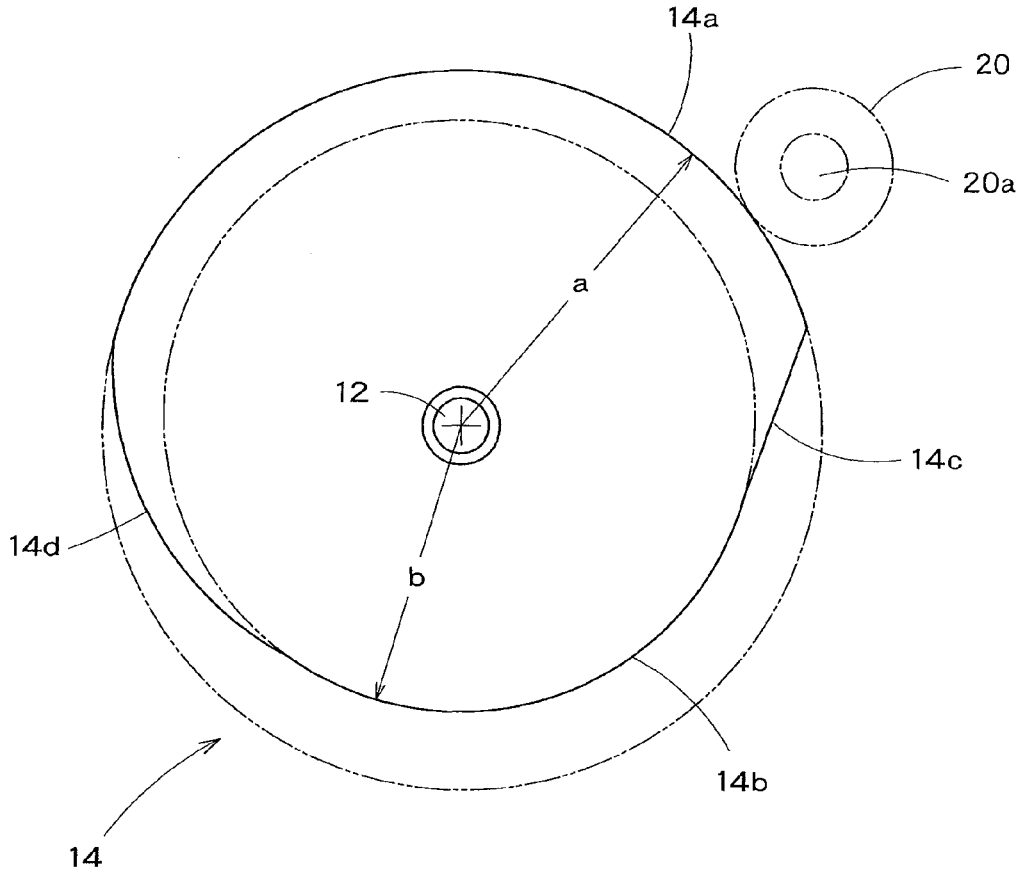
FIG. 3 is an enlarged structural view showing in detail a structure of a stationary cam of the paper sheet stacking apparatus shown in FIG. 1.

An embodiment according to the present invention will be described below. FIGS. 1 to 12 are views showing a paper sheet stacking apparatus in this embodiment. FIG. 1 is a side view showing a structure of the paper sheet stacking apparatus in this embodiment. FIG. 2 is a top view taken along the line A-A of the paper sheet stacking apparatus shown in FIG. 1. FIG. 3 is an enlarged structural view showing in detail a structure of a stationary cam of the paper sheet stacking apparatus shown in FIG. 1. FIGS. 4 to 12 are side views showing a series of operations when paper sheets are stacked on the stacking unit of the paper sheet stacking unit shown in FIG. 1.

At first, the structure of the paper sheet stacking apparatus in this embodiment is described with reference to FIGS. 1 to 3. The paper sheet stacking apparatus in this embodiment is adapted to stack paper sheets, such as banknotes and checks fed from outside, on one another. In FIG. 2, a paper sheet sent from outside to the paper sheet stacking apparatus is indicated by the reference character "P" for reference. In FIGS. 1 and 2, paper sheets are fed from the left side of the paper sheet stacking apparatus to the inside of the paper sheet stacking apparatus.

As shown in FIGS. 1 and 2, the paper sheet stacking apparatus in this embodiment includes a feeding roller 26 configured to feed in paper sheets one by one from outside the paper sheet stacking apparatus, a rotary body 10 having a holding member 16 for holding the paper sheet fed in by the feeding roller 26, and a stacking stage 32 on which the paper sheets transported by the rotary body 10 are stacked on one another. By rotating the rotary body 10 together with the paper sheet that is held by the holding member 16, the paper sheet is transported along the rotational direction of the rotary body 10 (clockwise direction in FIG. 1).

Details of the respective constituent elements of the paper sheet stacking apparatus shown in FIGS. 1 to 3 are described herebelow.

In the paper sheet stacking apparatus, the feeding roller 26 and a table 28 are arranged on a location in which paper sheets are fed from outside to the inside of the paper sheet stacking apparatus. The feeding roller 26 is configured to be rotated in the clockwise direction in FIG. 1 (direction indicated by the arrow in FIG. 1), so as to feed paper sheets from the left side of FIG. 1 to the right side thereof along a substantially horizontal direction. An endless belt 22 extending substantially horizontally is disposed near to the feeding roller. The endless belt 22 is supported by a plurality of pulleys 24 arranged in a line along the substantially horizontal direction. One pulley 24 of the plurality of pulleys 24 is equipped with a drive motor. When the one pulley 24 is driven in rotation by the drive motor, the endless belt 22 is revolved in a counterclockwise direction in FIG. 1 (direction indicated by the arrow in FIG. 1). Details of the structure of the endless belt 22 will be described below.

When a paper sheet is fed to the inside of the paper sheet stacking apparatus from outside, the paper sheet is fed by the feeding roller 26 on the table 28 from the left side of FIG. 1 to the right side thereof. The paper sheet fed thereinto is sent further rightward in FIG. 1 so as to be delivered to the rotary body 10.

Disposed near to the feeding roller 26 is a paper sheet detection sensor 30 configured to detect a paper sheet which has been fed by the feeding roller 26 from outside. More specifically, the paper sheet detection sensor 30 is composed of a pair of upper and lower light-emitting part and light-receiving part. Light emitted from the light-emitting part can be received by the light-receiving part. When a paper sheet is sent to a position between the light-emitting part and the light-receiving part of the paper sheet detection sensor 30, the light emitted from the light-emitting part is interrupted by the paper sheet, whereby the paper sheet fed by the feeding roller 26 from outside can be detected.

The rotary body 10 is configured to be rotated in the clockwise direction in FIG. 1 (direction indicated by the arrow in FIG. 1) about a shaft 12. In more detail, the rotary body 10 is equipped with a drive motor (not shown) formed of a stepper motor, for example. The rotary body 10 can be driven in rotation by the drive motor. As described above, a paper sheet fed in by the feeding roller 26 from outside is sent to the rotary body 10. In more detail, a direction, along which the paper sheet is transported by the feeding roller 26 (specifically, the right direction in FIG. 1) immediately before the paper sheet is delivered from the feeding roller 26 to the rotary body 10, substantially corresponds to a direction, along which the paper sheet is transported by the rotary body 10 immediately after the paper sheet has been delivered from the feeding roller 26 to the rotary body 10.

As shown in FIG. 2, the pair of right and left rotary bodies 10 are arranged when seen from above. The shafts 12 of the two rotary bodies 10 are arranged substantially collinearly. Namely, as shown in FIG. 1, when the paper sheet stacking apparatus is seen from the lateral side, the two rotary bodies 10 are overlapped with each other. The endless belt 22 is positioned between the two rotary bodies 10.

Figure 4:
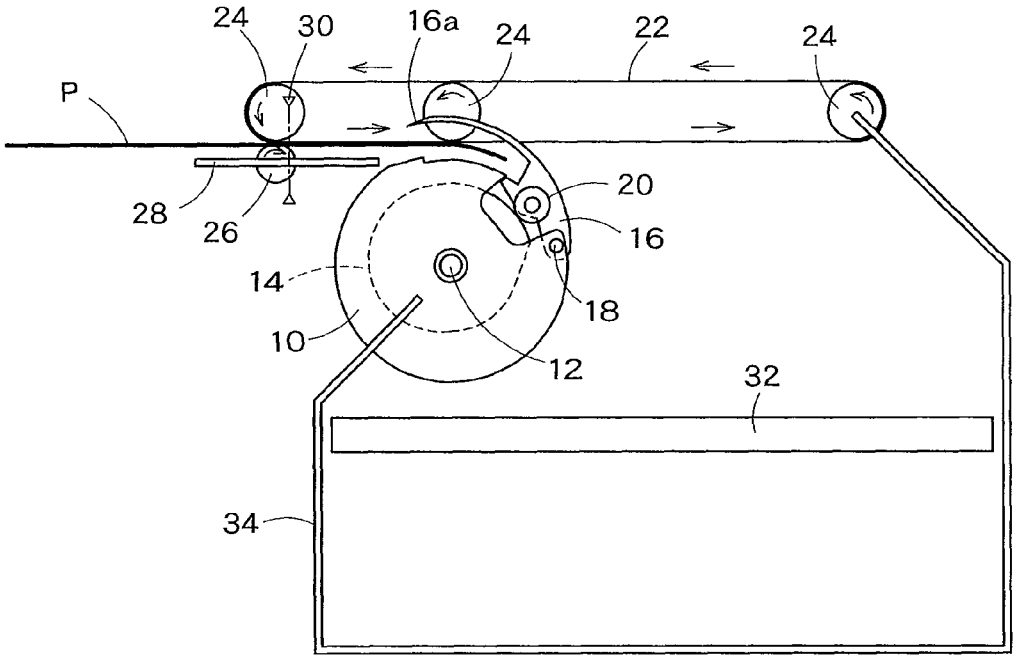
FIG. 4 is a side view showing a series of operations when paper sheets are stacked on a stacking unit of the paper sheet stacking apparatus shown in FIG. 1.
Figure 5:
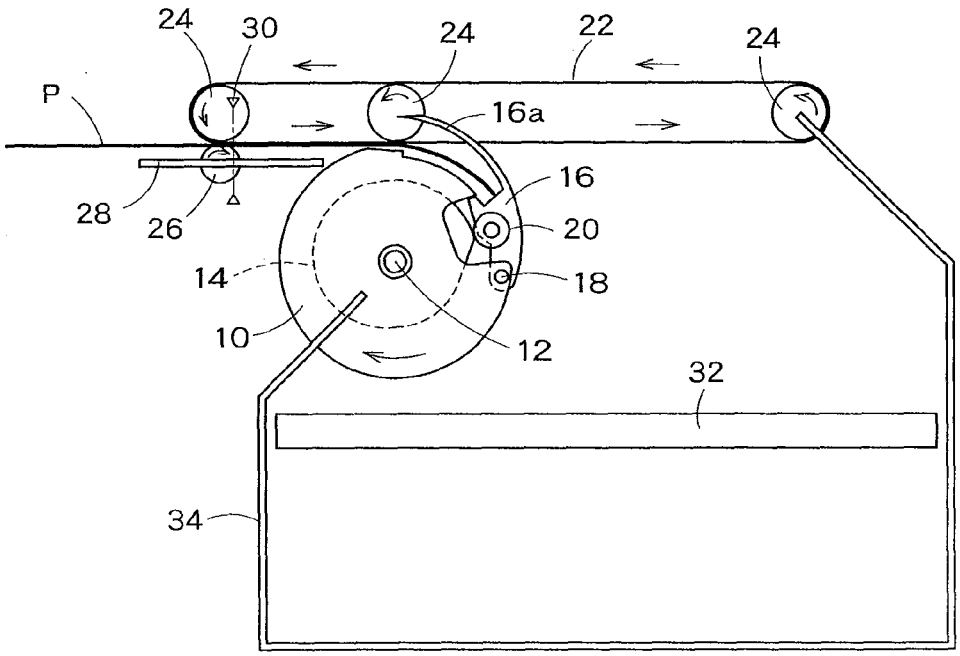
FIG. 5 is a side view showing a series of operations when the paper sheets are stacked on the stacking unit of the paper sheet stacking apparatus shown in FIG. 1.
Figure 6:
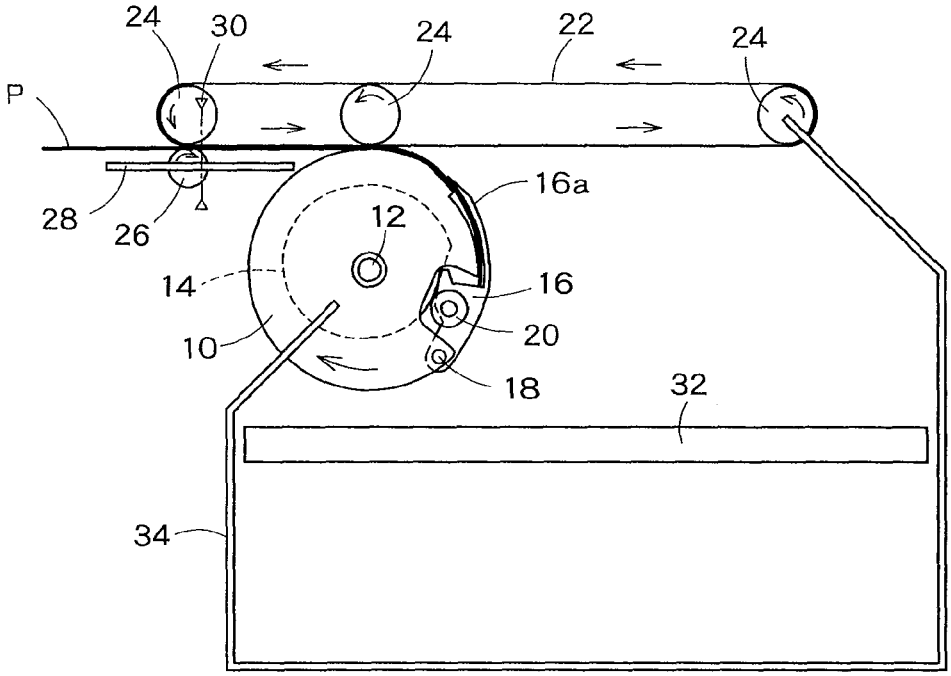
FIG. 6 is a side view showing a series of operations when the paper sheets are stacked on the stacking unit of the paper sheet stacking apparatus shown in FIG. 1.
Figure 7:
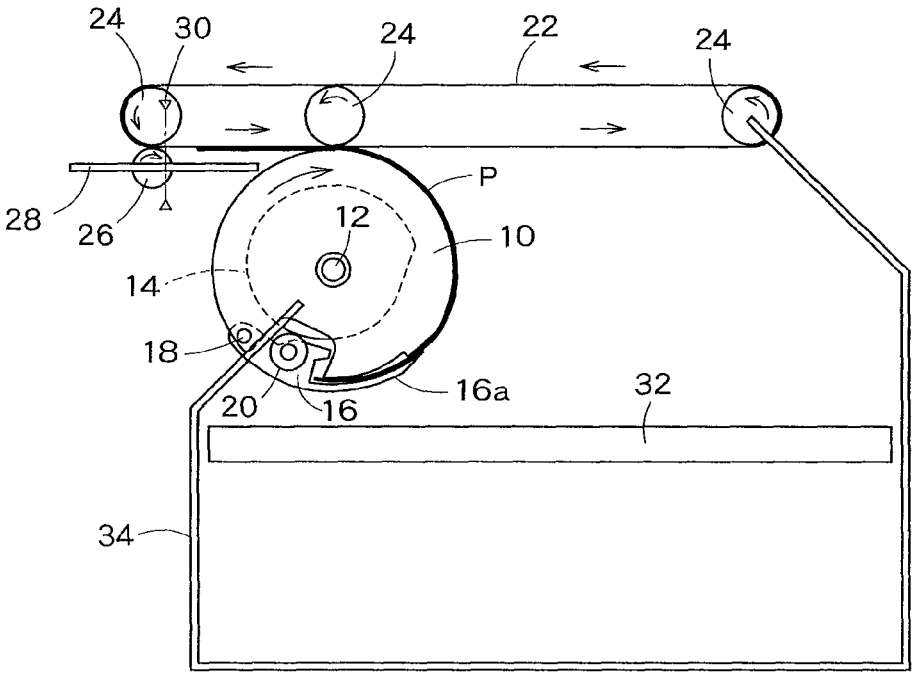
FIG. 7 is a side view showing a series of operations when the paper sheets are stacked on the stacking unit of the paper sheet stacking apparatus shown in FIG. 1.

The rotary body 10 has the holding member 16. The holding member 16 is swingably disposed on a side surface of the rotary body 10 by a shaft 18. In more detail, the holding member 16 is movable between a hold position, which is shown in FIGS. 6 and 7, at which a distal end 16*a* of the holding member 16 (an end farthest from the shaft 18) is close to an outer circumferential surface of the rotary body 10 so that a paper sheet is held between the distal end 16*a* of the holding member 16 and the outer circumferential surface of the rotary body 10, and a retreat position, which is shown in FIGS. 4 and 5, at which the distal end 16*a* of the holding member 16 is retreated from the outer circumferential surface of the rotary body 10.

In addition, a spring member (not shown) is disposed on the holding member 16. The holding member 16 is biased by this spring member toward the position at which the holding member 16 is in contact with the outer circumferential surface of the rotary body 10. Namely, the holding member 16 is biased by the spring member disposed on the holding member 16 in the counterclockwise direction in FIG. 1 about the shaft 18.

In addition, a circular member 20 is disposed on the holding member 16 via a shaft 20*a*. The circular member 20 is rotatable about the shaft 20*a* with respect to the holding member 16. In addition, the circular member 20 is configured to be in contact with an outer circumferential surface of a stationary cam 14 which is described below.

Disposed near to the rotary body 10 is the stationary cam 14 formed of a plate-like member of a substantially circular shape. A position of the stationary cam 14 is fixed, and the circular member 20 rotatably disposed on the holding member 16 is configured to be moved along the outer circumferential surface of the stationary cam 14.

The structure of the stationary cam 14 is described in detail with reference to FIG. 3. The outer circumferential surface of the stationary cam 14 has a first outer circumferential portion 14*a* and a second outer circumferential portion 14*b*. The first outer circumferential portion 14*a* is a part of a circumference whose center corresponds to a center of the shaft 12. As shown in FIG. 3, a length of a radius of the circumference is "a". The second outer circumferential portion 14*b* is a part of a circumference whose center corresponds to the center of the shaft 12. As shown in FIG. 3, a length of a radius of the circumference is "b" that is smaller than "a". Namely, the first outer circumferential portion 14*a* is located on a position that is more distant from the center of the shaft 12 than the second outer circumferential portion 14*b*. In the outer circumferential surface of the stationary cam 14, there are connection portions 14*c* and 14*d* respectively between the first outer circumferential portion 14*a* and the second outer circumferential portion 14*b*.

As shown in FIG. 1, when the circular member 20 rotatably disposed on the holding member 16 is in contact with the first outer circumferential portion 14*a* of the stationary cam 14, the distance "a" between the center of the shaft 12 and any position on the first circumferential portion 14*a* is relatively large. Thus, the distal end 16*a* of the holding member 16 is away from the outer circumferential surface of the rotary body 10 against the biasing force of the spring member. Namely, when the circular member 20 is in contact with the first outer circumferential portion 14*a* of the stationary cam 14, the holding member 16 is located on the retreat position at which the distal end 16*a* of the holding member 16 is retreated from the outer circumferential surface of the rotary body 10.

On the other hand, when the rotary body 10 is rotated about the shaft 12 in the clockwise direction in FIG. 1 (direction indicated by the arrow in FIG. 1) so that the circular member 20 is moved from the first outer circumferential portion 14*a* to the second outer circumferential portion 14*b* via the connection portion 14*c*, the distance "b" between the center of the shaft 12 and any position on the second circumferential portion 14*b* is relatively small. Thus, the distal end 16*a* of the holding member 16 is adjacent to the outer circumferential surface of the rotary body 10 by the biasing force of the spring member. Namely, when the circular member 20 is in contact with the second outer circumferential portion 14*b* of the stationary cam 14, the holding member 16 is located on the hold position at which the distal end 16*a* of the holding member 16 is close to the outer circumferential surface of the rotary body 10 so as to hold a paper sheet between the distal end 16*a* of the holding member 16 and the outer circumferential surface of the rotary body 10.

Thereafter, when the rotary body 10 is further rotated about the shaft 12 in the clockwise direction in FIG. 1 (direction indicated by the arrow in FIG. 1) so that the circular member 20 is moved from the second outer circumferential portion 14*b* of the stationary cam 14 to the first circumferential portion 14*a* via the connection portion 14*d*, the distal end 16*a* of the holding member 16 again comes away from the outer circumferential surface of the rotary body 10 against the biasing force of the spring member. In this manner, the holding member 16 is returned to the retreat position at which the distal end 16*a* of the holding member 16 is retreated from the outer circumferential surface of the rotary body 10.

Namely, the spring member disposed on the holding member 16 and the circular member 20, which is rotatably disposed on the holding member 16 and is configured to be in contact with the outer circumferential surface of the stationary cam 14, constitute a holding member moving mechanism for moving the holding member 16 between the hold position, which is shown in FIGS. 6 and 7, and the retreat position, which is shown in FIGS. 4 and 5. As described above, the holding member moving mechanism automatically moves the holding member 16 between the hold position and the retreat position, in accordance with the rotation of the rotary body 10.

On the stacking stage 32, paper sheets transported by the rotary body 10 can be stacked on one another. As shown by the arrow in FIG. 1, the stacking stage 32 is movable along an up and down direction in FIG. 1. When no paper sheet is stacked on the stacking stage 32, the stacking stage 32 is located on a top position. As paper sheets are sent from the rotary body 10 to the stacking stage 32, the stacking stage 32 is gradually moved downward.

As shown in FIGS. 1 and 2, an outer frame 34 is disposed around the stacking stage 32. When paper sheets sent from the rotary body 10 to the stacking stage 32 so as to be stacked thereon, the outer frame 34 is configured to prevent the stacked paper sheets on the stacking stage 32 from being displaced from each other.

The function of the endless belt 22 disposed near to the feeding roller 26 is to guide an edge portion of the paper sheet, which is not held by the holding member 16, i.e., the rear edge portion of the paper sheet in the transport direction, to the stacking stage 32, when a paper sheet is transported by the rotary body 10. The method of guiding the rear edge portion of the paper sheet by the endless belt 22 will be described below. A speed at which the rear edge portion of the paper sheet is transported by the endless belt 22 is equal to or greater than a speed at which the paper sheet is transported by the feeding roller 26.

When seen from the lateral side of the paper sheet stacking apparatus, i.e., when seen along the axial direction of the rotary body 10, as shown in FIG. 4, the endless belt 22 is located on a position overlapped with the holding member 16 immediately before a paper sheet is delivered from the feeding roller 26 to the rotary body 10. In other words, immediately before a paper sheet is delivered from the feeding roller 26 to the rotary body 10, the distal end 16*a* (the end for holding a paper sheet) of the holding member 16 is located on a position that is more distant from the outer circumferential surface of the rotary body 10 than the endless belt 22.

Next, an operation of the paper sheet stacking apparatus as structured above will be described with reference to FIGS. 4 to 12. In FIGS. 4 to 12, a paper sheet is indicated by the reference character "P" for reference.

Before a paper sheet P is fed by the feeding roller 26 to the inside of the paper sheet stacking apparatus, the rotary body 10 is stopped at a position shown in FIG. 1. At this time, the circular member 20 rotatably disposed on the holding member 16 is in contact with the first outer circumferential portion 14*a* of the stationary cam 14, so that the holding member 16 is located on the retreat position at which the distal end 16*a* of the holding member 16 is retreated from the outer circumferential surface of the rotary body 10. In addition, as shown in FIG. 1, when seen from the lateral side of the paper sheet stacking apparatus, i.e., when seen along the axial direction of the rotary body 10, the endless belt 22 and the holding member 16 are overlapped with each other, and the distal end 16*a* of the holding member 16 is located on a position that is more distant from the outer circumferential surface of the rotary body 10 than the endless belt 22.

When the paper sheet P is sent from outside to the paper sheet stacking apparatus and the paper sheet P is fed by the feeding roller 26 to the inside of the paper sheet stacking apparatus, a front edge portion of the paper sheet P in the transport direction is detected by the paper sheet detection sensor 30. After a predetermined period of time (e.g., 0.1 seconds) has passed from the detection of the front edge portion of the paper sheet P by the paper sheet detection sensor 30, the drive motor disposed on the rotary body 10 starts to rotate the rotary body 10 in the clockwise direction in FIG. 1. At this time, the drive motor rotates the rotary body 10, such that a rotational speed of the rotary body 10 is gradually increased from 0 to a predetermined value, and that the rotational speed is maintained at this predetermined value thereafter. FIG. 4 is a view showing that, after a predetermined period of time has passed from the detection of the front edge portion of the paper sheet P, which has been fed in by the feeding roller 26 from outside, by the paper sheet detection sensor 30, the rotary body 10 starts to be rotated. Instead of starting the rotation of the rotary body 10 after a predetermined period of time has passed from the detection of the front edge portion of the paper sheet P by the paper sheet detection sensor 30, the rotation of the rotary body 10 may be started at a timing when the front edge portion of the paper sheet P is detected by the paper sheet detection sensor 30.

Thereafter, as shown in FIG. 5, the rotary body 10 is rotated in the clockwise direction in FIG. 5, with the holding member 16 being located on the retreat position and the front edge portion of the paper sheet P being located in the space between the holding member 16 and the outer circumferential surface of the rotary body 10. Then, when the circular member 20 rotatably disposed on the holding member 16 is moved from the first outer circumferential portion 14*a* of the stationary cam 14 to the second outer circumferential portion 14*b* via the connection portion 14*c*, as shown in FIG. 6, the distal end 16*a* of the holding member 16 is pressed onto the outer circumferential surface of the rotary body 10 by the biasing force of the spring member disposed on the holding member 16. In this manner, the holding member 16 is moved to the hold position, so that the paper sheet P is held between the distal end 16*a* of the holding member 16 and the outer circumferential surface of the rotary body 10.

As described above, before the paper sheet P is delivered from the feeding roller 26 to the rotary body 10, the holding member 16 is located on the retreat position. Then, after a predetermined period of time has passed from the detection of the paper sheet P, which has been fed in by the feeding roller 26 from outside, by the paper sheet detection sensor 30, the holding member 16 is moved from the retreat position to the hold position so as to hold the paper sheet P which has been sent from the feeding roller 26 to the rotary body 10.

Figure 8:
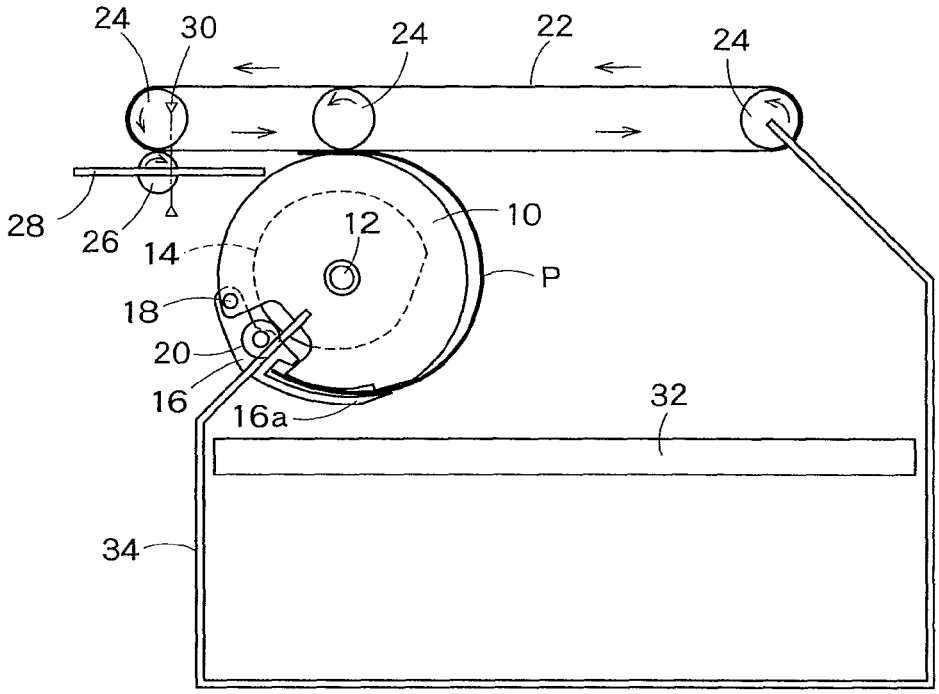
FIG. 8 is a side view showing a series of operations when the paper sheets are stacked on the stacking unit of the paper sheet stacking apparatus shown in FIG. 1.

Thereafter, the rotary body 10 is rotated at a predetermined rotational speed, with the paper sheet P being held between the distal end 16*a* of the holding member 16 and the outer circumferential surface of the rotary body 10, so that the rotary body 10 reaches a position as shown in FIG. 7. When the rotary body 10 reaches the position shown in FIG. 7, the drive motor disposed on the rotary body 10 gradually decreases the rotational speed of the rotary body 10 from the predetermined value. Then, when the rotary body 10 reaches a position as shown in FIG. 8, the rotary body 10 is completely stopped. While the rotary body 10 is located on each position as shown in FIGS. 6 to 8, the circular member 20 rotatably disposed on the holding member 16 is in contact with the second outer circumferential portion 14*b* of the stationary cam 14, so that the holding member 16 is located on the hold position. In addition, while the rotary body 10 is located on each position as shown in FIGS. 6 to 8, the paper sheet P is in contact with the outer circumferential surface of the rotary body 10.

Under the state shown in FIG. 8, the rotary body 10 is completely stopped. However, the endless belt 22 is continuously revolved, whereby the rear edge portion of the paper sheet P in the transport direction is continuously moved rightward in FIG. 8 by the endless belt 22. As shown in FIG. 8, while the rotary body 10 is being stopped, the rear edge portion of the paper sheet P is continuously moved rightward in FIG. 8 by the endless belt 22, with the front edge portion of the paper sheet P being held by the holding member 16, whereby the paper sheet P comes away from the outer circumferential surface of the rotary body 10.

Figure 9:
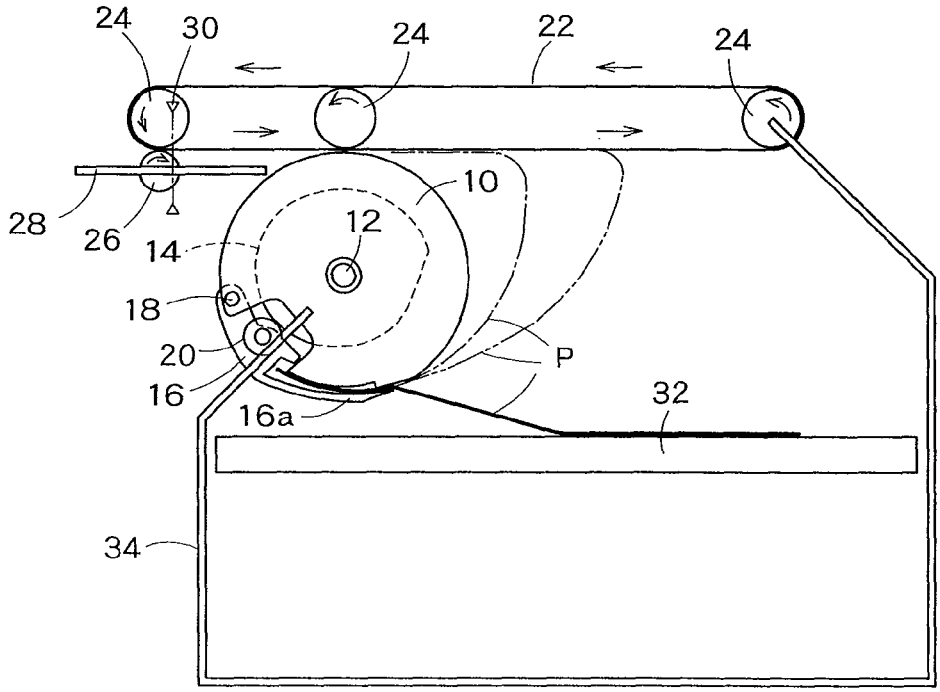
FIG. 9 is a side view showing a series of operations when the paper sheets are stacked on the stacking unit of the paper sheet stacking apparatus shown in FIG. 1.

As shown by the dotted line in FIG. 9, when the rear edge portion of the paper sheet P in the transport direction is further moved by the endless belt 22 while the rotary body 10 is being stopped, the rear edge portion of the paper sheet P is guided by the endless belt 22 such that the rear edge portion of the paper sheet P comes further away from the rotary body 10. Then, as shown in the solid line in FIG. 9, the rear edge portion of the paper sheet P is finally guided up to the stacking stage 32. Note that, when the rear edge portion of the paper sheet P is placed on the stacking stage 32, the front edge portion of the paper sheet P is still held by the holding member 16.

Figure 10:
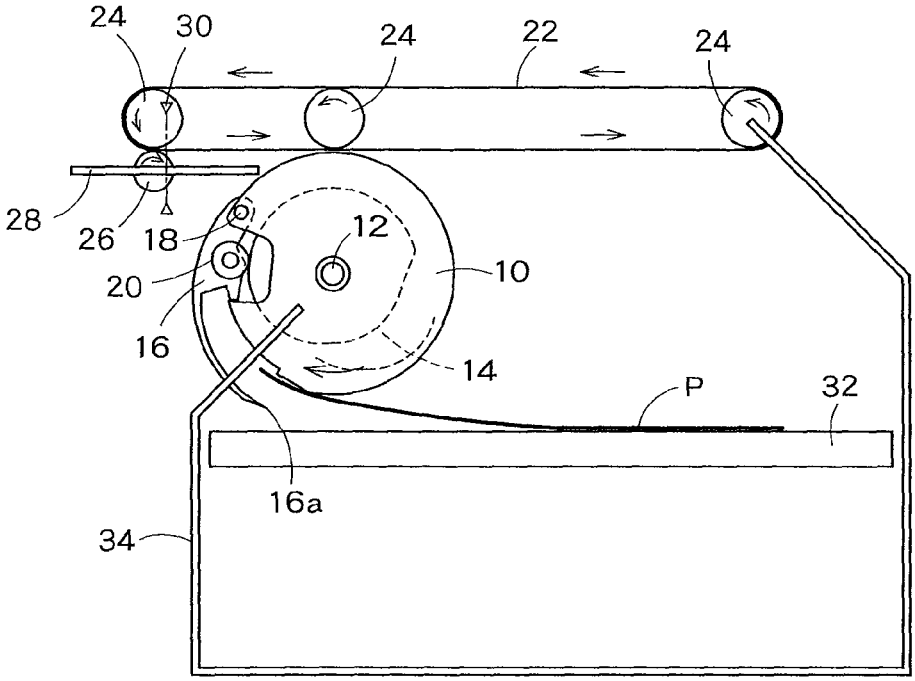
FIG. 10 is a side view showing a series of operations when the paper sheets are stacked on the stacking unit of the paper sheet stacking apparatus shown in FIG. 1.

While the rotary body 10 is being stopped as shown in FIGS. 8 and 9, after a predetermined period of time has passed from the time when the event that the paper sheet P, which had been fed in by the feeding roller 26 from outside, completely passed through the paper sheet detection sensor 30 was detected (i.e., after a predetermined time has passed from the time when the rear edge portion of the paper sheet P in the transport direction, which had been fed in by the feeding roller 26 from outside, was detected by the paper sheet detection sensor 30), the drive motor disposed on the rotary body 10 again starts to rotate the rotary body 10 in the clockwise direction in FIG. 8. At this time, the drive motor rotates the rotary body 10, such that a rotational speed of the rotary body 10 is gradually increased from 0 to a predetermined value, and that the rotational speed is maintained at this predetermined value thereafter. Then, as shown in FIG. 10, when the circular member 20 rotatably disposed on the holding member 16 is moved from the second outer circumferential portion 14*b* of the stationary cam 14 to the first outer circumferential portion 14*a* via the connection portion 14*d*, the distal end 16*a* of the holding member 16 is retreated from the outer circumferential surface of the rotary body 10 against the biasing force of the spring member disposed on the holding member 16. In this manner, the holding member 16 is moved from the hold position to the retreat position, so that the front edge portion of the paper sheet P is released from the holding member 16. Then, the rotary body 10 is further rotated from the stated shown in FIG. 10, the front edge portion paper sheet P falls downward so as to be placed on the stacking stage 32.

Alternatively, while the rotary body 10 is being stopped as shown in FIGS. 8 and 9, at a timing when the event that the paper sheet P, which had been fed in by the feeding roller 26 from outside, completely passed through the paper sheet detection sensor 30 is detected, i.e., for example, at a timing when the rear edge portion of the paper sheet P in the transport direction, which has been fed from outside by the feeding roller 26, is detected by the paper sheet detection sensor 30, the rotation of the rotary body 10 may be again started so that the holding member 16 is moved from the hold position to the retreat position, so that the paper sheet P is released from the holding member 16 which holds the paper sheet P so far, whereby the paper sheet P is delivered from the rotary body 10 to the stacking stage 32. In addition, as a further alternative embodiment, after a predetermined period of time has passed from the time when the rotary body 10 was completely stopped as shown in FIG. 8, the drive motor disposed on the rotary body 10 may again start to rotate the rotary body 10 in the clockwise direction in FIG. 8.

Figure 11:
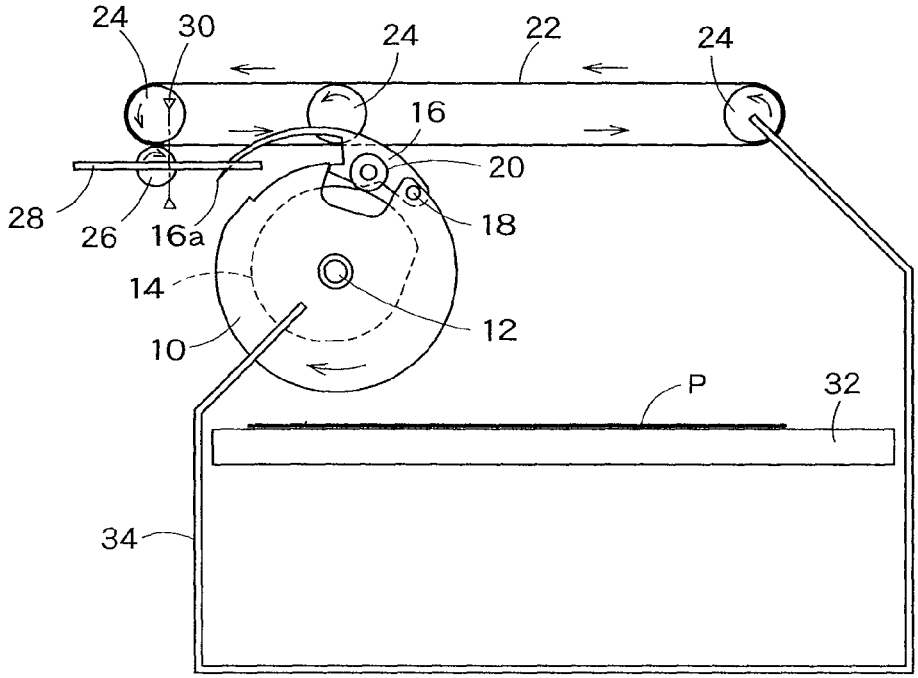
FIG. 11 is a side view showing a series of operations when the paper sheets are stacked on the stacking unit of the paper sheet stacking apparatus shown in FIG. 1.
Figure 12:
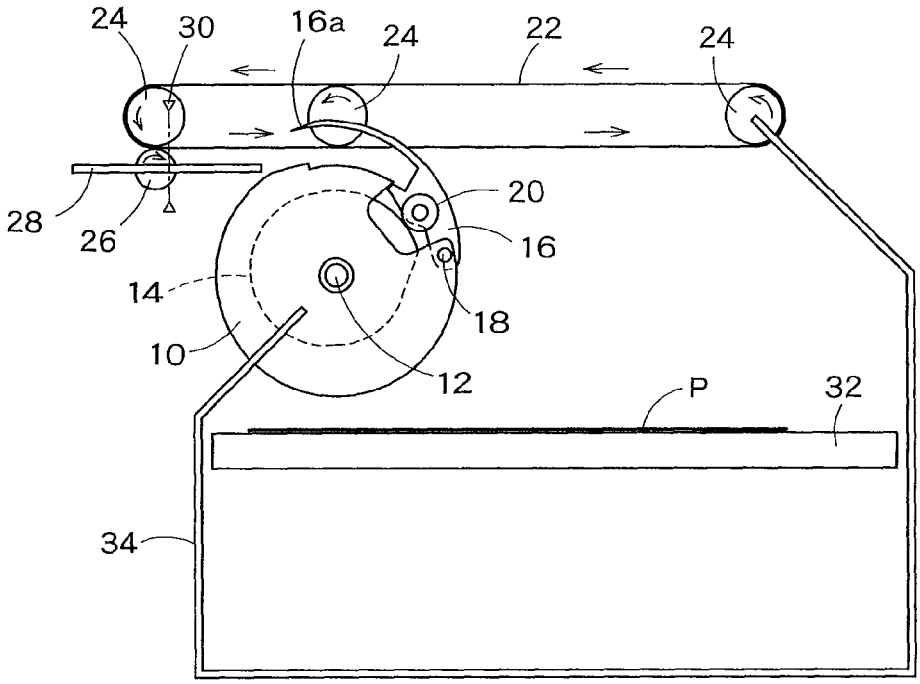
FIG. 12 is a side view showing a series of operations when the paper sheets are stacked on the stacking unit of the paper sheet stacking apparatus shown in FIG. 1.

Thereafter, when the rotary body 10 reaches a position as shown in FIG. 11, the drive motor disposed on the rotary body 10 gradually decreases the rotational speed of the rotary body 10 from the predetermined value. At this time, the paper sheet P is completely placed on the stacking stage 32. Then, when the rotary body 10 reaches a position as shown in FIG. 12, the rotary body 10 is stopped, and a subsequent paper sheet P is fed by the feeding roller 26 from outside to the inside of the paper sheet stacking apparatus. After the subsequent paper sheet P has been fed in by the feeding roller 26, the operation as shown in FIGS. 4 to 12 of the paper sheet stacking apparatus is repeated.

As described above, according to the paper sheet stacking apparatus in this embodiment, there is provided the rotary body 10 having the holding member 16 for holding a paper sheet fed in by the feeding roller 26. By rotating the rotary body 10 with a paper sheet being held by the holding member 16, the paper sheet can be transported along the rotational direction of the rotary body 10. Namely, when the paper sheet fed in by the feeding roller 26 from outside is sent to the stacking stage 32 by the rotary body 10, the paper sheet can be held by the holding member 16 of the rotary body 10. Thus, in the course of rotation of the rotary body 10, there is no possibility that the paper sheet might separate away from the rotary body 10. Due to this structure, as compared with a paper sheet stacking apparatus in which a paper sheet is sandwiched between a pair of vanes of a stacking wheel before the paper sheet is stacked on the stacking stage 32, paper sheets fed from outside can be reliably stacked on one another on the stacking stage 32. Therefore, a failure in stacking condition of paper sheets on the stacking stage 32 can be restrained.

In addition, as compared with a paper sheet stacking apparatus including a stacking wheel having a pair of vanes for sandwiching therebetween a paper sheet, since it is sufficient that only a part of the paper sheet is held by the holding member 16, the size of the rotary body 10 can be reduced, whereby the reduction in size of the paper sheet stacking apparatus can be achieved.

In addition, in the paper sheet stacking apparatus in this embodiment, the feeding roller 26 is adapted to feed in a paper sheet from outside along the substantially horizontal direction. The direction, in which the paper sheet is transported by the feeding roller 26 (specifically, the right direction in FIG. 1), immediately before the paper sheet is delivered from the feeding roller 26 to the rotary body 10, substantially corresponds to the direction, in which the paper sheet is transported by the rotary body 10, immediately after the paper sheet has been delivered from the feeding roller 26 to the rotary body 10.

In addition, the holding member 16 is movable between the hold position (see FIGS. 6 and 7) at which the distal end 16*a* of the holding member 16 is close to the outer circumferential surface of the rotary body 10 so that a paper sheet is held between the distal end 16*a* and the outer circumferential surface of the rotary body 10, and the retreat position (see FIGS. 4 and 5) at which the distal end 16*a* of the holding member 16 is retreated from the outer circumferential surface of the rotary body 10.

In addition, the holding member 16 is provided with the holding member moving mechanism for moving the holding member 16 between the hold position and the retreat position. To be specific, the holding member moving mechanism is composed of the spring member disposed on the holding member 16, and the circular member 20 that is rotatably disposed on the holding member 16 and is configured to be in contact with the outer circumferential surface of the stationary cam 14. The holding member moving mechanism can automatically move the holding member 16 between the hold position and the retreat position, in accordance with the rotation of the rotary body 10. In more detail, there is provided the stationary cam 14 whose position is fixed, and the circular member 20 is adapted to be moved along the outer circumferential surface (periphery) of the stationary cam 14 by the rotation of the rotary body 10. When the rotary body 10 is rotated, the circular member 20 is moved along the outer circumferential surface of the stationary cam 14, so that the holding member 16 is moved between the hold position and the retreat position.

In addition, in the paper sheet stacking apparatus in this embodiment, the feeding roller 26 is provided with the paper sheet detection sensor 30 configured to detect a front edge portion of a paper sheet which has been fed in by the feeding roller 26 from outside. As shown in FIG. 4, when a paper sheet fed in by the feeding roller 26 from outside is detected by the paper sheet detection sensor 30, or after a predetermined period of time has passed from the detection of the paper sheet, which has been fed in by the feeding roller 26 from outside, by the paper sheet detection sensor 30, rotation of the rotary body 10 is started.

In addition, as shown in FIGS. 4 to 6, before the paper sheet is delivered from the feeding roller 26 to the rotary body 10, the holding member 16 is located on the retreat position. After a predetermined period of time has passed from the detection of the paper sheet, which was fed in by the feeding roller 26 from outside, by the paper sheet detection sensor 30, the holding member 16 is moved from the retreat position to the hold position, so that the paper sheet delivered from the feeding roller 26 to the rotary body 10 can be held.

In addition, in the paper sheet stacking apparatus in this embodiment, the rotary body 10 is rotated, with a paper sheet being held by the holding member 16, up to a stacking position at which the paper sheet is stacked on the stacking stage 32. In addition, when the event that a predetermined period of time has passed from the time when the passage of the paper sheet, which had been fed in by the feeding roller 26 from outside, through the paper sheet detection sensor 30 was detected, is detected, or after a predetermined period of time has passed from the time when the passage of the paper sheet through the paper sheet detection sensor 30 was detected, the paper sheet held by the holding member 16 is released, whereby the paper sheet is delivered from the rotary body 10 to the stacking stage 32 so as to be stacked on the stacking stage 32.

In addition, in the paper sheet stacking apparatus in this embodiment, disposed near to the rotary body 10 is the endless belt 22 configured to guide an edge portion of the paper sheet, which is not held by the holding member 16, up to the stacking staged 32, when the paper sheet is transported by the rotary body 10. Owing to the provision of the endless belt 22, when the rear edge portion of the paper sheet is guided by the endless belt 22, an area through which the rear edge portion of the paper sheet passes is smaller than an area corresponding to a rotational trajectory of the rear edge portion of the paper sheet when the rotary body 10 is rotated with the paper sheet being merely held by the holding member 16. Namely, the passage area of the paper sheet is limited to an area below the endless belt 22. Thus, even when paper sheets such as large size banknotes or checks are stacked on the stacking stage 32, a space required for the paper sheets to pass therethrough up to the stacking stage 32 can be relatively made small, whereby the reduction in size of the paper sheet stacking apparatus can be achieved.

In addition, the speed at which the paper sheet is transported by the endless belt 22 is equal to or greater than the speed at which the paper sheet is transported by the feeding roller 26. If the feeding speed of paper sheet by the feeding roller 26 is greater than the transport speed of paper sheet by the endless belt 22, since the transport speed of the paper sheet by the endless belt 22 is relatively small, a part of the paper sheet that has passed through the feeding roller 26 may be curved. In this case, the paper sheet cannot be appropriately guided by the endless belt 22 up to the stacking stage 32, and there is a possibility that the paper sheet stacking apparatus might be jammed with paper sheets. On the other hand, when the transport speed of the paper sheet by the endless belt 22 is equal to or greater than the transport speed of the paper sheet by the feeding roller 26, such a trouble can be avoided.

In addition, when seen along the axial direction of the rotary body 10, i.e., when seen from the lateral side of the paper sheet stacking apparatus, the endless belt 22 is disposed on a position that is overlapped with the holding member 16 immediately before a paper sheet is delivered from the feeding roller 26 to the rotary body 10. Namely, immediately before the paper sheet is delivered from the feeding roller 26 to the rotary body 10, the distal end 16*a* (the end for holding a paper sheet) of the holding member 16 is located on a position that is more distant from the outer circumferential surface of the rotary body 10 than the endless belt 22. Thus, when the paper sheet, which has been fed in by the feeding roller 26, is delivered to the rotary body 10, the front edge portion of the paper sheet in the transport direction is reliably sent to a space between the outer circumferential surface of the rotary body 10 and the endless belt 22. Since this space is located between the outer circumferential surface of the rotary body 10 and the holding member 16, the front edge portion of the paper sheet that is present in the space can be reliably held between the outer circumferential surface of the rotary body 10 and the holding member 16, when the holding member 16 is moved from the retreat position to the hold position. Thus, even if the front edge portion of the paper sheet fed in by the feeding roller 26 is creased, the creased paper sheet can be reliably held by the holding member 16.

The paper sheet stacking apparatus in this embodiment is not limited to the above embodiment, but can be variously modified.

For example, in the paper sheet stacking apparatus shown in FIGS. 1 to 3, the rotary body 10 is provided with the one holding member 16. However, the rotary body 10 may be provided with the two or more holding members 16. For example, when the rotary body 10 is provided with the two holding members 16, the two holding members 16 are disposed on the rotary body 10 at such positions that are symmetric with each other about the shaft 12.

In addition, in the paper sheet stacking method as shown in FIGS. 4 to 12, the rotary body 10 is rotated with a paper sheet being held by the holding member 16, and then the rotary body 10 is once stopped. Thereafter, the rear edge portion of the paper sheet in the transport direction is guided by the endless belt 22 to the stacking stage 32, and then the rotary body 10 is rotated again. However, after the rotary body 10 has been rotated with the paper sheet being held by the holding member 16, the rotary body 10 may not be stopped. Also in this case, since the rotary body 10 is rotated in the clockwise direction in FIG. 1, the circular member 20 rotatably disposed on the holding member 16 is moved from the second outer circumferential portion 14*b* of the stationary cam 14 to the first outer circumferential portion 14*a* via the connection portion 14*d*, so that the holding member 16 is moved from the hold position to the retreat position. At this time, the rear edge portion of the paper sheet has been already guided to the stacking stage 32 by the endless belt 22. Then, the front edge portion of the paper sheet is released from the holding member 16, and the front edge portion of the paper sheet collides with an inclined portion of the outer frame 34, for example, whereby the paper sheet falls downward so as to be stacked on the stacking stage 32.

In the case the rotary member 10 is not stopped after the rotary member 10 has been rotated with the paper sheet being held by the holding member 16, the paper sheet may be disengaged from the holding member 16 located on the hold position, by bringing the paper sheet into contact with the inclined portion of the outer frame 34, for example, while the paper sheet is continuously held by the holding member 16. Namely, by bringing the paper sheet into contact with the outer frame 34 while the rotary member 10 is continuously rotated, the paper sheet is pulled out from the holding member 16 against the holding force of the holding member 16. After the paper sheet has been pulled out from the holding member 16, the holding member 16 is moved from the hold position to the retreat position. In this case, since the paper sheet is pulled out from the holding member 16 so as to be stacked on the stacking stage 32, by bringing the paper sheet into contact with the outer frame 34, the outer frame 34 functions as a guiding mechanism for the paper sheet. Thus, positions of the front edge portions of the paper sheets (left edge portions in FIG. 1) stacked on one another can be aligned.

Figure 13:
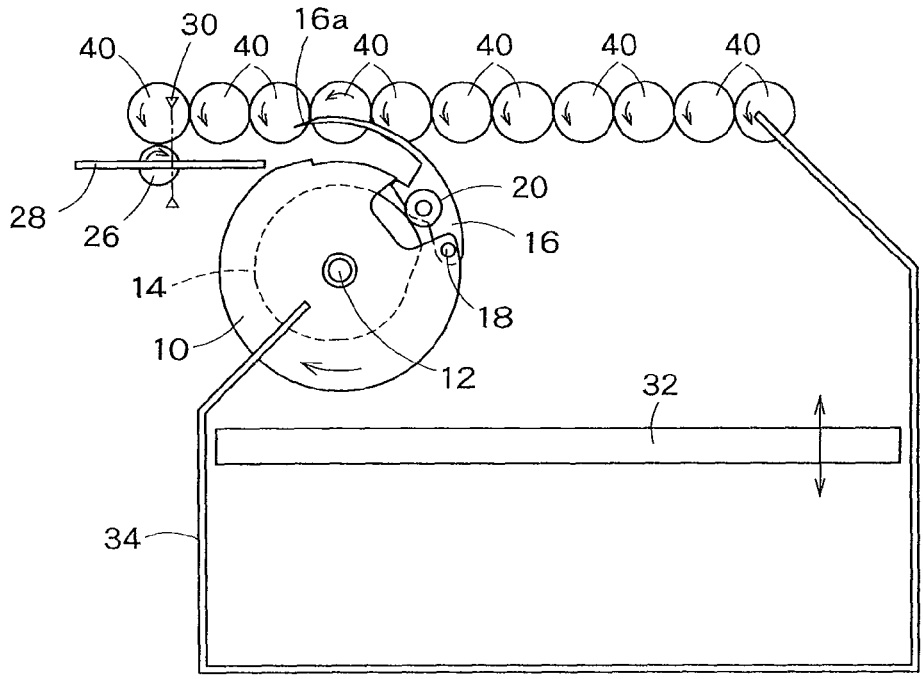
FIG. 13 is a side view showing another structure of the paper sheet stacking apparatus in one embodiment according to the present invention.
Figure 14:
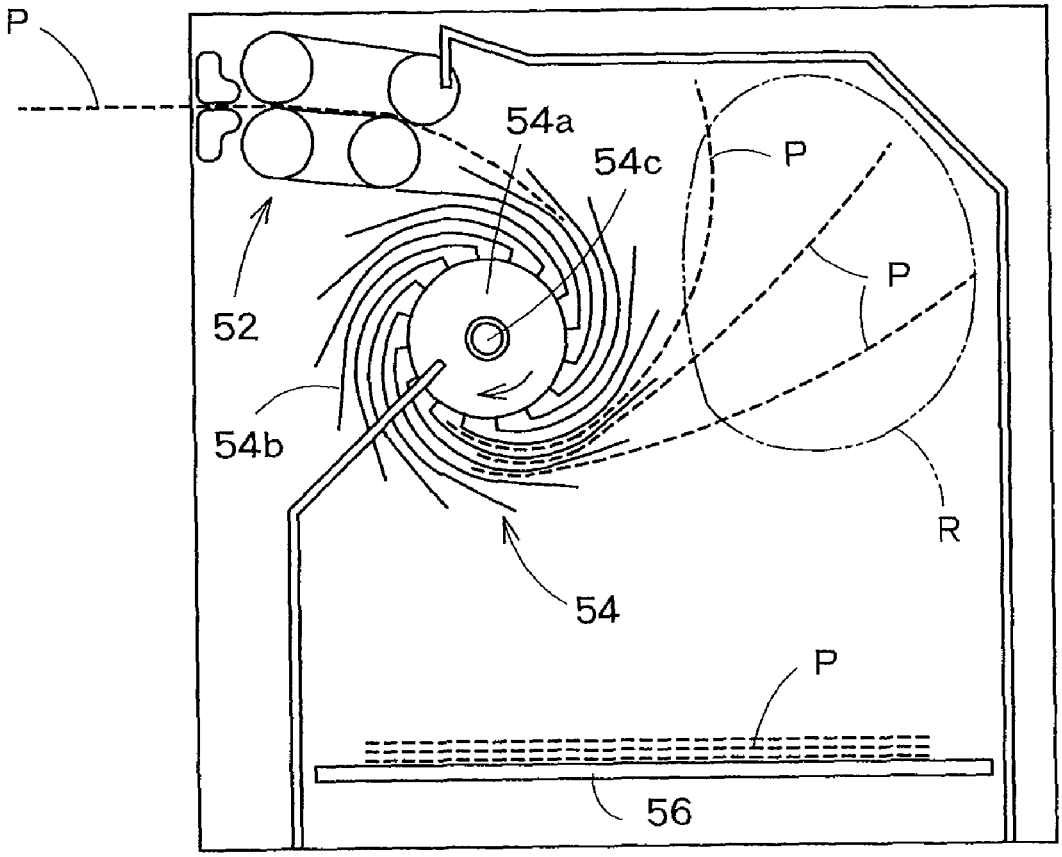
FIG. 14 is a side view of a structure of a conventional paper sheet stacking apparatus in which a stacking unit is provided with a stacking wheel.

In addition, the mechanism for guiding, when the paper sheet is transported by the rotary body 10, an edge portion of the paper sheet, which is not held by the holding member 16, i.e., the rear edge portion of the paper sheet, up to the stacking stage 32 is not limited to the endless belt 22. FIG. 13 is a side view showing another structure of the paper sheet stacking apparatus in this embodiment. The paper sheet stacking apparatus shown in FIG. 13 differs from the paper sheet stacking apparatus shown in FIGS. 1 to 12 only in that there are provided a plurality of transport assisting rollers 40 in place of the endless belt 22. Other structures thereof are substantially the same as those of the paper sheet stacking apparatus shown in FIGS. 1 to 12.

In the paper sheet stacking apparatus shown in FIG. 13, the plurality of transport assisting rollers 40 are arranged in serial along the substantially horizontal direction above the rotary body 10. Similarly to the endless belt 22, the transport assisting rollers 40 are configured to guide, when a paper sheet is transported by the rotary body 10, an edge portion of the paper sheet, which is not held by the holding member 16, i.e., the rear edge portion of the paper sheet, up to the stacking stage 32.

Due to the provision of the transport assisting rollers 40, when the rear edge portion of the paper sheet is guided by the respective transport assisting rollers 40, an area through which the rear edge portion of the paper sheet passes is smaller than an area corresponding to a rotational trajectory of the rear edge portion of the paper sheet when the rotary body 10 is rotated with the paper sheet being merely held by the holding member 16. Namely, the passage area of the paper sheet is limited to an area below the respective transport assisting rollers 40. Thus, even when paper sheets such as large size banknotes or checks are stacked on the stacking stage 32, a space required for the paper sheets to pass therethrough up to the stacking stage 32 can be relatively made small, whereby the reduction in size of the paper sheet stacking apparatus can be achieved.

In addition, a speed at which a paper sheet is transported by the respective transport assisting rollers 40 is equal to or greater than a speed at which a paper sheet is transported by the feeding roller 26. If the feeding speed of the paper sheet by the feeding roller 26 is greater than the transport speed of the paper sheet by the respective transport assisting rollers 40, since the transport speed of the paper sheet by the respective transport assisting rollers 40 is relatively small, a part of the paper sheet that has passed through the feeding roller 26 may be curved. In this case, the paper sheet cannot be appropriately guided by the respective transport assisting rollers 40 up to the stacking stage 32, and there is a possibility that the paper sheet stacking apparatus might be jammed with paper sheets. On the other hand, when the transport speed of the paper sheet by the respective transport assisting rollers 40 is equal to or greater than the transport speed of the paper sheet by the feeding roller 26, such a trouble can be avoided.

In addition, when seen along the axial direction of the rotary body 10, i.e., when seen from the lateral side of the paper sheet stacking apparatus, some of the plurality of transport assisting rollers 40 are disposed on positions that are overlapped with the holding member 16 immediately before a paper sheet is delivered from the feeding roller 26 to the rotary body 10. Namely, immediately before the paper sheet is delivered from the feeding roller 26 to the rotary body 10, the distal end 16*a* (the end for holding a paper sheet) of the holding member 16 is located on a position that is more distant from the outer circumferential surface of the rotary body 10 than the transport assisting rollers 40. Thus, when the paper sheet, which has been fed in by the feeding roller 26, is delivered to the rotary body 10, the front edge portion of the paper sheet in the transport direction is reliably sent to a space between the outer circumferential surface of the rotary body 10 and the respective transport assisting rollers 40. Since this space is located between the outer circumferential surface of the rotary body 10 and the holding member 16, the front edge portion of the paper sheet that is present in the space can be reliably held between the outer circumferential surface of the rotary body 10 and the holding member 16, when the holding member 16 is moved from the retreat position to the hold position. Thus, even if the front edge portion of the paper sheet fed in by the feeding roller 26 is creased, the creased paper sheet can be reliably held by the holding member 16.

In addition, as a mechanism for guiding, when a paper sheet is transported by the rotary body 10, an edge portion of the paper sheet, which is not held by the holding member 16, i.e., the rear edge portion of the paper sheet, up to the stacking stage 32, another member other than the endless belt 22 and the transport assisting rollers 40 may be used.

The invention claimed is:

1. A paper sheet stacking apparatus configured to stack paper sheets sent from outside on one another, the paper sheet stacking apparatus comprising:

a feeding unit configured to feed in paper sheets one by one from outside;

a rotary body including a holding member for holding the paper sheet fed in by the feeding unit, the rotary body being configured to be rotated with the paper sheet being held by the holding member, so as to transport the paper sheet along a rotational direction of the rotary body;

a stacking unit on which the paper sheets transported by the rotary body are stacked on one another, and a transport assisting unit disposed near to the rotary body, the transport assisting unit is configured to guide, when the paper sheet is transported by the rotary body, an edge portion of the paper sheet, which is not held by the holding member, up to the stacking unit, and when seen along an axial direction of the rotary body, the transport assisting unit is disposed at a position that is overlapped with the holding member, such that the holding member extends above a portion of the transport assisting unit immediately before the paper sheet is delivered from the feeding unit to the rotary body.

2. The paper sheet stacking apparatus according to claim 1, wherein the feeding unit is configured to feed in the paper sheets from outside along a substantially horizontal direction.

3. The paper sheet stacking apparatus according to claim 1, wherein a direction, along which the paper sheet is transported by the feeding unit immediately before the paper sheet is delivered from the feeding unit to the rotary body, substantially corresponds to a direction, along which the paper sheet is transported by the rotary body immediately after the paper sheet has been delivered from the feeding unit to the rotary body.

4. The paper sheet stacking apparatus according to claim 1, wherein the holding member is movable between a hold position at which the holding member is close to an outer circumferential surface of the rotary body so that a paper sheet is held between the holding member and the outer circumferential surface of the rotary body, and a retreat position at which the holding member is retreated from the outer circumferential surface of the rotary body.

5. The paper sheet stacking apparatus according to claim 4, wherein the holding member is provided with a holding member moving mechanism configured to move the holding member between the hold position and the retreat position, and the holding member moving mechanism is configured to automatically move the holding member between the hold position and the retreat position, in accordance with the rotation of the rotary body.

6. The paper sheet stacking apparatus according to claim 5, further comprising a cam whose position is fixed, wherein the holding member moving mechanism has a member provided to the holding member, the member being configured to be moved along a periphery of the cam by the rotation of the rotary body, and when the rotary body is rotated, the member is moved along the periphery of the cam so that the holding member is moved between the hold position and the retreat position.

7. The paper sheet stacking apparatus according to claim 1, wherein the feeding unit is provided with a paper sheet detection unit configured to detect a paper sheet fed in by the feeding unit from outside, and when the paper sheet fed in by the feeding unit from outside is detected by the paper sheet detection unit, or after a predetermined period of time has passed from the time when the paper sheet was detected by the paper sheet detection unit, the rotary body is started to be rotated.

8. The paper sheet stacking apparatus according to claim 7, wherein the holding member is movable between a hold position at which the holding member is close to an outer circumferential surface of the rotary body so that a paper sheet is held between the holding member and the outer circumferential surface of the rotary body, and a retreat position at which the holding member is retreated from the outer circumferential surface of the rotary body, and before the paper sheet is delivered from the feeding unit to the rotary body, the holding member is located on the retreat position, and after a predetermined period of time has passed from the time when the paper sheet fed in by the feeding unit from outside was detected, the holding member is moved from the retreat position to the hold position so that the paper sheet sent from the feeding unit to the rotary body is held.

9. The paper sheet stacking apparatus according to claim 8, wherein the rotary body is rotated, with the paper sheet being held by the holding member, up to a stacking position at which the paper sheet is stacked on the stacking unit.

10. The paper sheet stacking apparatus according to claim 7, wherein when the event that the paper sheet fed in by the feeding unit from outside has passed through the paper sheet detection unit is detected, or after a predetermined period of time has passed from the time when the passage of the paper sheet through the paper sheet detection unit was detected, the paper sheet is released from the holding member which holds the paper sheet so far, so that the paper sheet is delivered from the rotary body to the stacking unit so as to be stacked on the stacking unit.

11. The paper sheet stacking apparatus according to claim 1, wherein the transport assisting unit is formed of an endless belt or a roller.

12. The paper sheet stacking apparatus according to claim 1, wherein a speed at which the paper sheet is transported by the transport assisting unit is equal to or greater than a speed at which the paper sheet is transported by the feeding unit.

13. The paper sheet stacking apparatus according to claim 1, wherein immediately before the paper sheet is delivered from the feeding unit to the rotary body, an end of the holding member for holding the paper sheet is located on a position that is more distant from an outer circumferential surface of the rotary body than the transport assisting unit.

* * * * *